US007008235B2

(12) United States Patent
Watanabe

(10) Patent No.: US 7,008,235 B2
(45) Date of Patent: Mar. 7, 2006

(54) COAXIAL CONNECTOR AND GROUND PAD THAT MOUNTS SAID COAXIAL CONNECTOR

(75) Inventor: Shinji Watanabe, Tokyo (JP)

(73) Assignee: Honda Tsushin Kogyo Co., Ltd., Tokyo (JP)

( * ) Notice: Subject to any disclaimer, the term of this patent is extended or adjusted under 35 U.S.C. 154(b) by 0 days.

(21) Appl. No.: 10/630,877

(22) Filed: Jul. 28, 2003

(65) Prior Publication Data

US 2004/0102061 A1 May 27, 2004

(30) Foreign Application Priority Data

Jul. 31, 2002 (JP) ..... 2002-222619

(51) Int. Cl.
*H01R 12/00* (2006.01)

(52) U.S. Cl. ..... 439/63; 439/581

(58) Field of Classification Search ..... 439/63, 439/581, 83
See application file for complete search history.

(56) References Cited

U.S. PATENT DOCUMENTS

| | | | | |
|---|---|---|---|---|
| 5,078,621 | A * | 1/1992 | Nishikawa et al. | 439/581 |
| 5,180,315 | A * | 1/1993 | Nagashima | 439/581 |
| 5,322,453 | A * | 6/1994 | Resnick et al. | 439/581 |
| 5,662,480 | A * | 9/1997 | Togashi | 439/63 |
| 5,772,470 | A * | 6/1998 | Togashi | 439/582 |
| 6,074,217 | A * | 6/2000 | Maruyama et al. | 439/63 |
| 6,347,405 | B1 * | 2/2002 | Boyko | 2/62 |
| 6,474,995 | B1 * | 11/2002 | Wu | 439/63 |
| 6,533,610 | B1 * | 3/2003 | Dai et al. | 439/581 |

* cited by examiner

*Primary Examiner*—P. Austin Bradley
*Assistant Examiner*—X. Chung-Trans
(74) *Attorney, Agent, or Firm*—Leighton K. Chong; Godbey Griffiths Reiss & Chong

(57) ABSTRACT

A coaxial connector has improved grounding capacity for high frequency waves and improved resistance against the peeling off of grounding terminals from ground pads and ground pads that mount the coaxial connectors and that have improved resistance against the peeling off of the ground pads from the circuit board. In the coaxial connector, corners 21*a* of ground terminals 21 that ground on ground pads 30 installed on circuit board 3 are characterized in that they are obtusely beveled or rounded, and the ground pad 30 that mounts the coaxial connector 1 is characterized in that it has a substantially square or U shape.

10 Claims, 8 Drawing Sheets

COAXIAL CONNECTOR AND GROUND PAD THAT MOUNTS SAID COAXIAL CONNECTOR

FIELD OF THE INVENTION

The present invention relates to coaxial connectors and ground pads that mount said coaxial connectors.

PRIOR ART

In recent years, electronic devices such as cellular phones and laptop computers have increasingly become smaller and very densely equipped with so many parts. For example, an ordinary coaxial connector 100 that uses Surface Mounting Technology (SMT) shown in FIGS. 14(*a*) and 14(*b*) is a female coaxial connector and is comprised of a contact 103 that comes into contact with and is electronically connected with a contact of a corresponding male connector (not shown), an insulator 107 that holds the contact 103 and a metallic shell 101 that contains the insulator 107. A shell 101 has a substantially cylindrical-shaped connecting section 101*a* that connects with a corresponding male connector and, in the near center location of the connecting section 101*a*, a contact 103 is locating. The contact 103 that has tips that are substantially U shaped, two-forked contact sections 103*a*, 103*a* is vertically installed. Then, a terminal section 105 extends across the central bottom section of the contact sections 103*a*, 103*a* and one end of this terminal section 105 is a signal terminal 105*a* in which electric signals run. As shown in FIG. 14(*c*), the signal terminal 105*a* is connected with a conductive pad 135 that is formed on the circuit board on which the coaxial connector is to be mounted. Furthermore, a terminal plunge-in part 106 that is an opposite end of terminal section 105 to the signal terminal 105*a* is plunged into an insert cavity 109 that is formed on the bottom section of the insulator 107 and the contact 103 can be fixed to the insulator 107. Then, on the right and left sides of the shell 101, to be connected with and be grounded by ground pads 130, 130, a pair of ground terminals 110, 110 are provided.

Said conventional surface-mounted coaxial connector 100 has only two ground terminals 110, 110 that are connected with ground pads 130, 130 on the circuit board, one on the right and the other on the left, so that the grounding capacity for high frequency waves is poor; given that a terminal section 105 of the contact section 103 has a gap 120 in view of preventing flux and tin soldering from going up, of forming a fillet on the connecting section and of providing spring function, the terminal section 105 on the bottom of the contact 103 may move downward (the direction of the arrow) when it gets connected to the corresponding male connector and, hence, not only the contact 103 itself may be deformed but also a signal terminal 105*a* may detach from a pad 135 or the pad may get peeled off of the circuit board; furthermore, if a protruding section of a terminal plunge-in part gets longer, electrical conductive property may worsen; moreover, if in the situation where the connectors are connected with each other, due to something bumping into the circuit board or an unexpected jerk, a force is added and a thrust is exerted on the coaxial connector 100, then that thrust might get directly exerted on the signal terminal 105*a* and the signal terminal 105*a* might detach from the pad 135 or the pad 135 might get peeled off of the circuit board. In order to provide a coaxial connector that solves these problems, the applicant for the present case has filed a patent application (2002-95985).

[Problems to be Solved]

In said patent application 2002-95985, although grounding capacity is to be improved by means of providing at least three ground terminals to be grounded on ground pads that are installed on the circuit board on or near the circle whose center is the center of the shell, there is such a problem that, because the corners of the ground terminals are like sharp edges having acute angles or right angles, when thrust is exerted on the coaxial connector, these corners may easily get peeled off and, from there, the ground terminals may peel off of the ground pads.

On the other hand, by means of making the whole of the bottom surface of the shell substantially be a ground terminal instead of providing protruding ground terminals and by means of connecting these ground terminals with the ground pad that has been installed on the circuit board, the grounding capacity is to be improved; however, in this case, there is such a problem that although the whole of the bottom surface of the shell is tin soldered, due to the surface tension of the soldered tin, the coaxial connector may float and that may hinder the coaxial connector from being mounted on the circuit board.

Furthermore, by having the terminal plunge-in part bent with a slight height in substantially perpendicular direction, the terminal plunge-in part is shorter than in conventional models and is embedded in the shallow inner surface of the insulator so that the stub is made smaller here than in conventional coaxial connectors in order to improve electric conductive property; however, no matter how slight a height it has, because the terminal plunge-in part is bent, the worsening effect on the conductive property of high frequency waves is not zero, and it is necessary to try to bring improvement in this regard.

Moreover, the terminal section is slightly bent so that a gap for a SMT back fillet can be formed between the terminal section and the circuit board; however, the terminal section is made longer just as much as the length of the bent section and therefore, if the electronic length becomes longer, the height of the coaxial connector gets bigger by that much. It is a very important point to try to minimize the height of the mounted parts in order to respond to the demand for minimization. Furthermore, there is such a problem that if one places a signal terminal outer to the outside of the shell, then that leads to the lengthening of the terminal section and in turn causes the lengthening of the electronic length.

Moreover, there is such a problem that, because conventional ground pads that are installed on the circuit boards and on which Surface Mounting Technology type coaxial connector gets mounted are, as shown in FIG. 14(*c*), provided separately in two places, right and left, depending on the connection, grounding may become unstable. Furthermore, there is such a problem that because the ground pads are installed separately in more than two locations, the total bottom surface area of the ground pads are small and, because the corners have acute angles, peeling off may start from these corners.

The present invention is designed to respond to these problems and, in addition to further improving the grounding capacity for high frequency waves, it aims to provide a coaxial connector with improved resistance against the peeling off of the ground terminals from the ground pads.

Furthermore, the present invention aims to provide a coaxial connector that can be solidly mounted on the circuit board without the floating of the coaxial connector itself due to the surface tension of the soldered tin.

Moreover, it aims to provide a coaxial connector with improved conductive property for high frequency waves.

Furthermore, it aims to provide a coaxial connector with a less height when it is mounted than conventional coaxial connectors.

Moreover, the present invention aims to provide ground pads on which a coaxial connector is mounted and that have stable ground electrical potential and to provide improved resistance against the peeling off of the ground pads from the circuit board.

[Means to Solve the Problems]

In order to solve said problems, the present invention is characterized in that: in a signal terminal that is provided on one of its sides and that comes into contact with the electrically-conductive pad that has been installed on a circuit board, a contact that electrically connects with the contact of a corresponding connector, an insulator that holds the contact and a metallic shell that contains the insulator and has ground terminals, the corners of the ground terminals that ground on the ground pads installed on the circuit board are obtusely beveled or rounded.

In order to solve said problems, the present invention in claim 2 is characterized in that: in a signal terminal that is provided on one of its sides and that comes into contact with the electrically-conductive pad that has been installed on a circuit board, a contact that electrically connects with the contact of a corresponding connector, an insulator that holds the contact and a metallic shell that contains the insulator and has ground terminals, the bottom end of said shell is a ground terminal provided with cuts with certain intervals in between.

In order to solve said problems, the present invention is characterized in that: said contact has a substantially U shaped contact section that electrically connects with a contact of a corresponding connector, a signal terminal that connects with a pad on one of its ends, and an terminal section that extends across the central bottom end of said contact section, it is characterized in that: an end of said terminal section opposite to said signal terminal is a terminal plunge-in part that is plunged into an insert cavity formed in said insulator and said terminal plunge-in part is designed to be plunged in substantially perpendicularly to the inner surface of said insulator.

In order to solve said problems, the present invention is characterized in that: in the coaxial connector, said terminal section is flat and whose bottom surface can be attached to said circuit board without any gap.

In order to solve said problems, the present invention is characterized in that: in a contact with a terminal section that horizontally extends across the central bottom end of a substantially U shaped contact section that comes into contact with and is electrically connected with a contact of a corresponding connector, an insulator that holds said contact, and a metallic shell that contains said insulator and has ground terminals, said terminal section has such a length that said terminal section can be stored inside of said insulator and has said signal terminal, being connected with a conductive pad on a circuit board, that is formed on the bottom section of said terminal section that is beneath said contact section near the center of said insulator.

In order to solve said problems, the present invention is characterized in that: in a ground pad on which a coaxial connector is mounted, a ground pad that is formed on said circuit board is substantially square shaped or substantially U shaped.

In order to solve said problems, the present invention is characterized in that: in the ground pad on which a coaxial connector is mounted, at least the corners on the outer perimeter of said ground pad are obtusely beveled or rounded.

EMBODIMENTS OF THE PRESENT INVENTION

Hereafter, coaxial connectors of the present invention will be described in detail by referring to figures. FIG. 1 is a plan view of one of the embodiments of the coaxial connector in the present invention. FIG. 2 is a side view of FIG. 1 as seen from the direction of Arrow A in FIG. 1. FIG. 3 is its bottom plan view. FIG. 4 is a cross-sectional view as seen on the cutting surface B—B in FIG. 1. FIG. 5 is a cross-sectional view when it is connected with a corresponding connector.

A coaxial connector in the figures is a Surface Mounting Technology type, namely a SMT type female coaxial connector and, as seen in FIG. 5, it is mounted on the surface of FPC (Flexible Printed Circuit) circuit board 3. The circuit board 3 can be either a hard PCB (Printed Circuit Board) or said flexible FPC board. Furthermore, a connecting corresponding male connector 50 in the figure is mounted on a PCB 5, but it can be mounted on a FPC board. A coaxial connector 1 has a contact 13 that comes into contact and electrically connects with a contact 53 of a corresponding male connector 50, an insulator 17 made of synthetic resin that holds the contact 13, and a metallic shell 11 that contains the insulator 17. The shell 11 has a cylindrical-shaped connecting section 11*a* that connects with the corresponding male connector 50 and in the substantially central location of the connecting section 11*a*, the contact 13 that is formed as substantially U-shaped and has two-forked tips is vertically installed.

The contact 13 has contact sections 13*a*, 13*a* that, being substantially U-shaped and having two-forked tips, come into contact with and is electrically connected with the contact 53 of the corresponding male connector 50, a terminal section 15 that has a signal terminal 15*a* on one of its ends that is connected with an electrically conductive pad extends across the central bottom end of the contact sections 13*a*, 13*a*. In other words, one end of the terminal section 15 is a signal section 15*a* in which electric signals run and is protruding outside of the shell 11. This signal section 15*a* is electrically connected with an electrically conductive pad 35 (shown in FIG. 13) on the circuit board 3.

On the other hand, the opposite end to the signal terminal 15*a* on the terminal section 15 is a terminal plunge-in part 15*b* to be plunged into an insert cavity 17*a* formed in the insulator 17; this terminal plunge-in part 15*b* is designed to be plunged in substantially perpendicularly to the inner wall of the insulator 17, namely it is designed as a protrusion parallel to the signal terminal 15*a*, and the bottom surface of the terminal section 15 is made flat so that it can be attached to the circuit board 3 without any gap. Furthermore, the top surface of this signal terminal 15*b* is, as shown in FIG. 11, tapered, and by being plunged into an insert cavity 17*a* of the insulator 17 as will be described later on, the contact 13 can be stored in the insulator. In this way, the terminal section 15 of the present embodiment has a shorter 15*a* since it is not slightly bent to form a gap 120 as in the conventional terminal section 105, and therefore, the electrical conductive property can be improved and the height of the mounted parts can be made less. In this way, it can meet the demand for minimization.

Even if the terminal section 15, just like a conventional model, is slightly bent to form a gap between the circuit board 3 and the bottom surface of the terminal section 15 (equivalent to the gap 120 for the conventional coaxial connector 100), the terminal plunge-in part 15*b* to be plunged into an insert cavity 17*a* in the insulator 17 can be plunged in substantially perpendicularly and it is not bent with a right angle so that the stab is made smaller, and, by that much, the electric conductive property can be improved.

An insulator 17 is made of synthetic resin and, as the contact 13 is kept in its substantial center, is contained in the shell 11. On the inner surface of the bottom section of the insulator 17, an insert cavity 17*a* is formed and into which the terminal plunge-in part 15*b* is to be plunged. An insert cavity 17*a* has a narrow opening and wide inside space so that, when the terminal plunge-in part 15*b* of the contact 13 is plunged in, the plunge-in section is fixed solid and, when it is connected with a corresponding male connector 50, the contact 13 does not move left or right. Furthermore, on the bottom surface of the insulator 17, positioning projections 17*b* are formed, and they will be inserted into positioning holes (not shown in the figure) formed on the circuit board 3 so that the coaxial connector can be set in the right position. In the present embodiment, there are two positioning projections 17*b*, but they are not limited to this number.

The shell 11 contains the insulator 17 in such a way that the lower section of the cylindrical-shaped connecting section 11*a* attaches to the insulator 17. In this way, when the corresponding male connector 50 gets connected, even if a thrust is exerted on said connecting section 11*a* due to the connecting action, because the connecting section 11*a* is held by the insulator 17, deformation of the shell 11 is prevented. Furthermore, the connecting section 11*a* is attached to and held by the insulator 17, positioning devices can also be installed on both the connecting section 11*a* and the insulator 17.

On the right and left sides of the shell 11, the first ground terminals 20 and the second ground terminals 21 that ground on the ground pad 30 on the circuit board 3 are provided. The first ground terminals 20 are provided symmetrically in relation to the shell 11 and they protrude from the lower section of the cylindrically shaped shell 11 and while being in contact with the ground pad 30, its tips are bent upward. These first ground terminals 20 are grounded at the contact locations with the ground pad 30. Furthermore, the upper surfaces of the ground terminals 20 are hooking sections 20*a* on to which, when said female connector is pulled off from the connecting corresponding male connector 50 by means of a disconnecting device (not shown), pressuring sections of the disconnecting device can be hooked.

On the shell 11, second ground terminals 21 are provided along a circle whose center is the center of the shell 11. In the present embodiment, in addition to four second ground terminals 21 that are provided 90 degrees apart and that protrude outward, on the opposite side of the signal terminal 15*a*, ground terminals 21 are formed to have wider shape along the attaching surface 11 and the total of five second ground terminals 21 are provided. Second ground terminals 21 should not be limited in terms of number, but given the first ground terminals 20 are provided in two locations, at least one, desirably 3 to 5 second ground terminals should be provided. Certainly there can be more second ground terminals 21. The point here is that they should have as large contact area with the ground pad 30 as possible.

The tips of the second ground terminals 21 are protruding more outward than the signal terminal 15*a*. In other words, the signal terminal 15*a* is designed to locate inside the imaginary broken line connecting the outward corners of the second ground terminals. In this way, when the coaxial connector 1 and the corresponding male connector 50 are connected, even if something bumps into the circuit board 3 or the circuit board is jerked, the thrust is placed on the second ground terminals 21, but is prevented from being placed on the signal terminal 15*a*. Hence, the peeling off of the signal terminal 15*a* from the pad 35 or that of the pad 35 from the circuit board can be prevented.

While the second ground terminals 21 that are connected to the ground pad 30 should be designed to have as large area as possible, the corners 21*a* should not be like edges with sharp angles but rounded. By having the corners 21*a* of the second ground terminals rounded, it becomes difficult for the corners 21 to get peeled off of the ground pad 30, and as a result, the peeling off of the second ground terminals 21 from the ground pad 30 that starts from there is effectively prevented. Moreover, the corners 21*a* do not have to be rounded but obtusely beveled. By having this form, like when they are rounded, it becomes difficult for the corners 21*a* to get peeled off of the ground pad 30, and as a result, the peeling off of the second ground terminals 21 from the ground pad 30 that starts from there is effectively prevented. Here, in order to refrain from making the figures too messy in FIGS. 1 and 3, only the corners of one of the ground terminals 21 are designated with 21*a*, but the other second ground terminals 21 have the same feature. As being shown here, the first and second ground terminals 20, 21 are mounted on the circuit 3 with the substantially equidistance from the shell 11, a thrust on the coaxial connector 1 does not concentrate on any particular ones of the first or second ground terminals 20, 21 and hence the coaxial connector 1 can be mounted securely. Here, second ground terminals 21 do not have to be provided on the circle whose center is the center of the shell 11 but could be provided near it.

The ground pad 30 on the circuit board 3 on which the coaxial connector is mounted has, as shown by FIGS. 12 and 13, a substantially square shape or substantially U shape and installed in such a manner that it rests on the largest area possible on the circuit board 3. In this way, in comparison with a conventional ground pads 130 that are separated and provided in more than two right and left locations, it can be installed with larger area. Furthermore, the ground pad 30 should be as large as possible and have a concentric shape. Moreover, the corners 30*a* that are locating on the outer perimeter among the corners of ground pads 30 are rounded and thereby the peeling off of the corners 30*a* from the circuit board 3 can be prevented. In this way, the peeling off of the ground pad 30 from the circuit board 3 that is caused by the peeling off of corners 30*a* can be effectively prevented. Furthermore, the corners 30*a* of the ground pad 30 do not have to be rounded but obtusely beveled. By having this form, like when they are rounded, it becomes difficult for the corners 30*a* to get peeled off of the circuit board 3, and as a result, the peeling off of the ground pad 30 from the circuit board 3 that starts from there is effectively prevented. The signal terminal 15*a* can be attached and electrically connected to the electrically conductive pad 35. In FIG. 13, the corners of the electrically conductive pad 35 are rounded.

Next, FIGS. 6 through 8 indicate the second embodiment of the coaxial connector in the present invention. FIG. 6 is its plan view, FIG. 7 is its side view and FIG. 8 is its bottom plan view.

The featured coaxial connector 1 is, just like said coaxial connector 1, a Surface Mounting Technology (SMT) type female coaxial connector and is mounted on the surface of the circuit board 3. The coaxial connector 1 is comprised of a contact 13, an insulator 17 made of synthetic resin that holds the contact 13 and a metallic shell 11 that contains the insulator 17. As for the contact 13 and insulator 17, they have the substantially same features as said coaxial connector 1 and their explanations for are omitted.

The whole of the bottom surface of the shell 11 in the present embodiment is a ground terminal 22 that connects and grounds with the ground pad 30 of the circuit board 3 and there are cuts 12 with certain intervals in between. The depth of the cuts 12 is designed to be approximately the same thickness as the tin to be soldered so that the floating of the coaxial connector due to the surface tension of the soldered tin is made smaller and the function of the coaxial connector when being mounted will be improved.

Next, FIG. 9 indicates a cross-sectional view of the third embodiment of the present invention.

The featured coaxial connector 1 is, just like said coaxial connectors 1, a Surface Mounting Technology (SMT) type female connector and is mounted on the surface of the circuit board 3. This coaxial connector 1 is comprised of a contact 13, an insulator 17 made of synthetic resin that holds the contact 13, and a metallic shell 11 that contains the insulator 17 and that has first ground terminals 20, 20 and second ground terminals 21. The shell 11 and insulator 17 have the substantially same features as said coaxial connector 1 and their explanations are omitted.

The contact 13 of the coaxial connector in the present embodiment is, as shown by FIGS. 10 and 11, provided with the terminal section 15 that substantially horizontally extends across the central bottom section and this terminal section 15 has such length that it can be contained within the insulator 17. Then, on the bottom of the terminal section 15 that locates below contact sections 13*a*, 13*a* in the near center of the insulator 17, a signal terminal 15*a* that protrudes downward is formed. The signal terminal 15*a* comes into contact with and is electrically connected with an electrically conductive pad 35 locating in the near center of the central empty space of the ground pad 30. On the both sides of the terminal section 15, terminal plunge-in parts 15*b*, 15*b* are provided. Because the signal terminal 15*a* is supported by the circuit board 3 by means of the pad 35, when the corresponding male connector 50 gets connected, there is no possibility of the contact 13 to move in the direction of the thrust that comes with the connecting action. In this way, the deformation of the contact 13 itself, the peeling off of the signal terminal 15*a* from the pad 15 or the peeling off of the pad 35 from the circuit board can be prevented.

Concerning the terminal plunge-in parts 15*b*, 15*b*, as in the coaxial connector of said first and second embodiments, the upper surface is tapered and because they are plunged into insert cavities 17*a*, 17*a* that are provided on the lower, inner surface of the insulator 17, the contact 13 can be stored within the insulator 17. In this case, because the contact 13 is contained within the insulator 17 and it becomes difficult to observe from the outside whether or not the contact has come into contact, a hole to confirm the mounting of the contact 13 should be provided on the insulator 17.

EFFECTS OF THE PRESENT INVENTION

As stated above, because the coaxial connector in the present invention has rounded or obtusely beveled corners of the ground terminals that are grounded on the ground pad on the circuit board, there is such an effect that the resistance against the peeling off of the ground terminals from the ground pad is improved.

In addition, in the coaxial connector of the present invention, because cuts with certain intervals in between are provided on the bottom surface of the shell, the coaxial connector can be mounted securely on the circuit board without floating due to the surface tension of the soldered tin.

Furthermore, in the coaxial connector in the present invention, because the terminal plunge-in part is made to be plunged in perpendicularly to the inner surface of the insulator and, since it is not bent with a right angle, stabs are made smaller by that much, so that there is such an effect that characteristics of high frequency waves are improved. Furthermore, by making the bottom surface of the terminal section of the contact flat and attaching it to the circuit board without any gap, the height of the mounted parts can be made less and, since the terminal section is not bent, stabs are made smaller by that much, so there is such an effect that the conductive property of high frequency waves can be improved.

Moreover, in the coaxial connector of the present invention, because the length of the terminal section is designed in such a manner that the terminal section of the contact can be stored within the insulator and the signal terminal is formed on the bottom surface of the terminal section locating near the center of the bottom of the contact section, there is such an effect that, given the length of the terminal section is made smaller in comparison with conventional coaxial connectors, the conductive property of the high frequency is further improved.

Furthermore, according to the ground pad on which the coaxial connector in the present invention is mounted, because the ground pad has a substantially square shape or substantially U shape and, at least, the outer corners of the ground pad are rounded or obtusely beveled, the stability of ground electrical potential and resistance against the peeling off of the ground pad from the circuit board can be improved.

EXPLANATIONS OF REFERENCED NUMERALS

Figure 1:
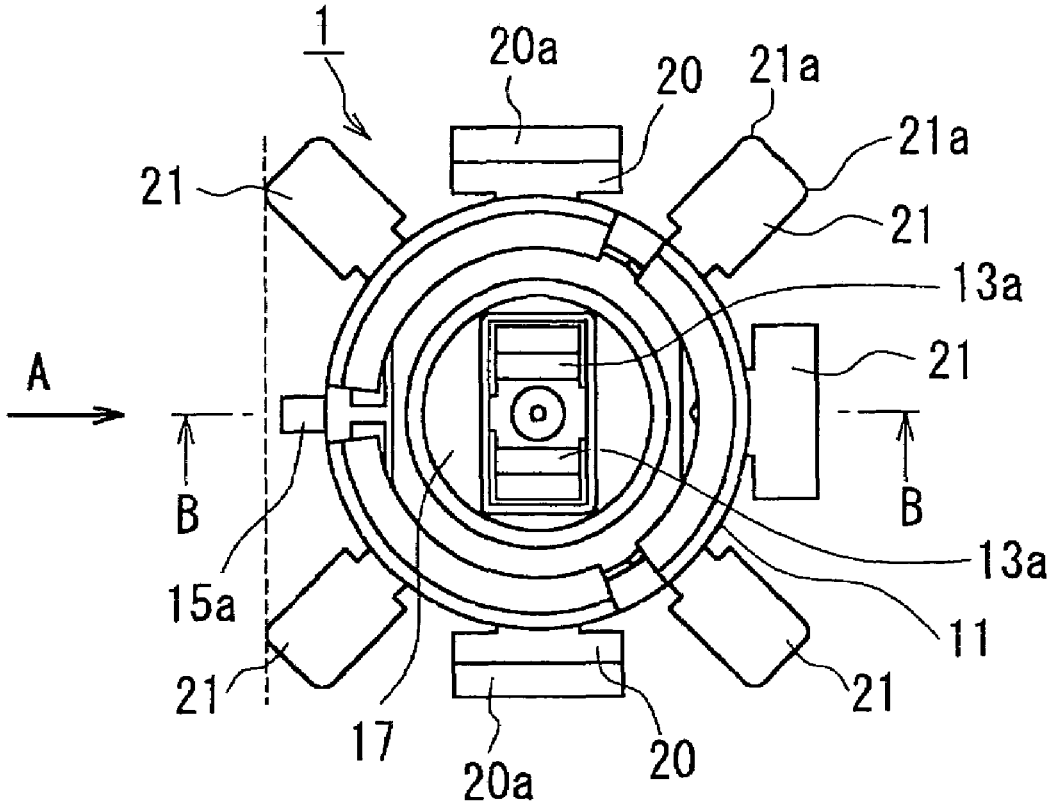
FIG. 1 A plan view of the first embodiment of the present invention.
Figure 2:
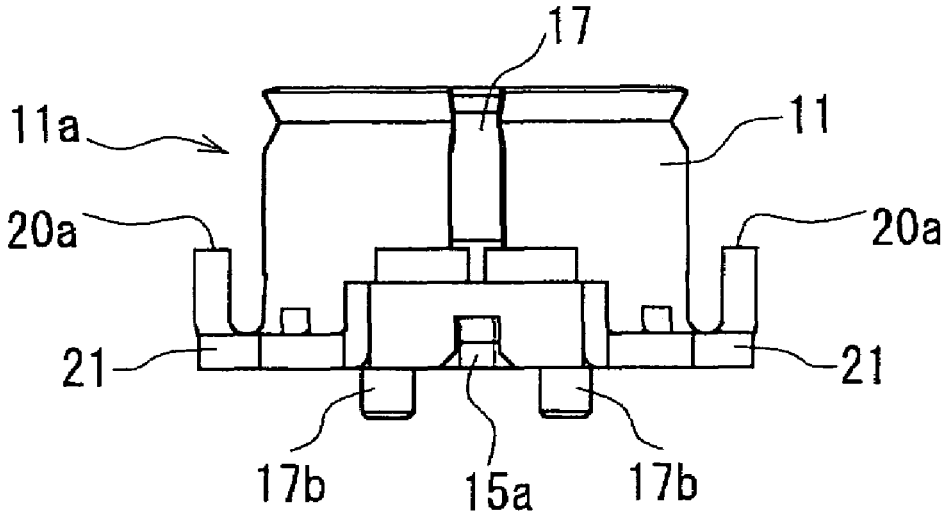
FIG. 2 A side view of the coaxial connector as seen from the direction of Arrow A of FIG. 1.
Figure 3:
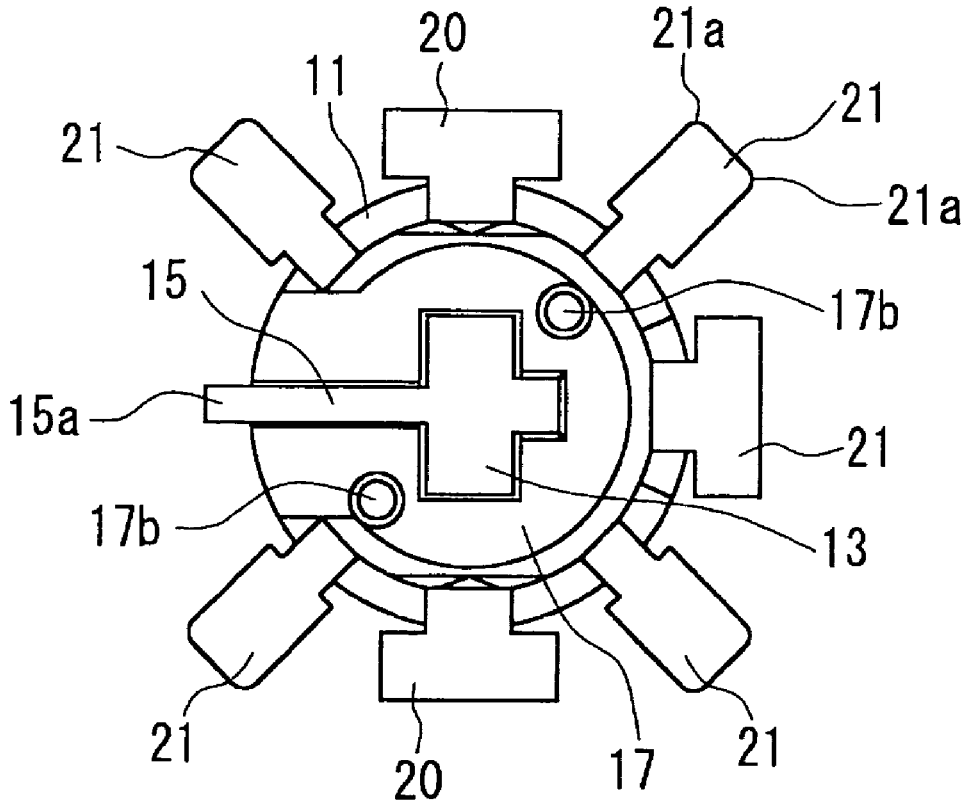
FIG. 3 A bottom plan view of the first embodiment of the present invention of FIG. 1.
Figure 4:
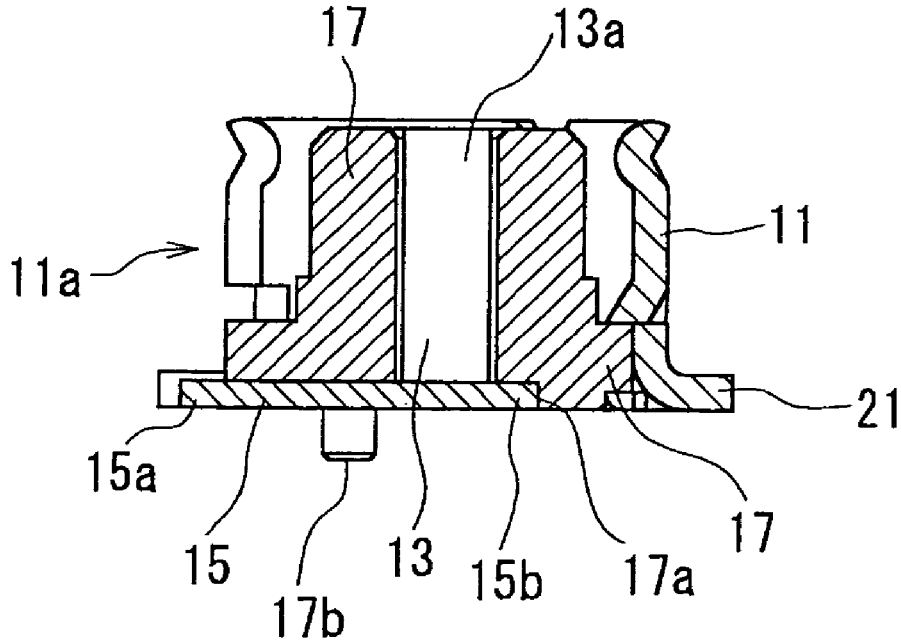
FIG. 4 A cross-sectional view of the coaxial connector along the line B—B of FIG. 1.
Figure 5:
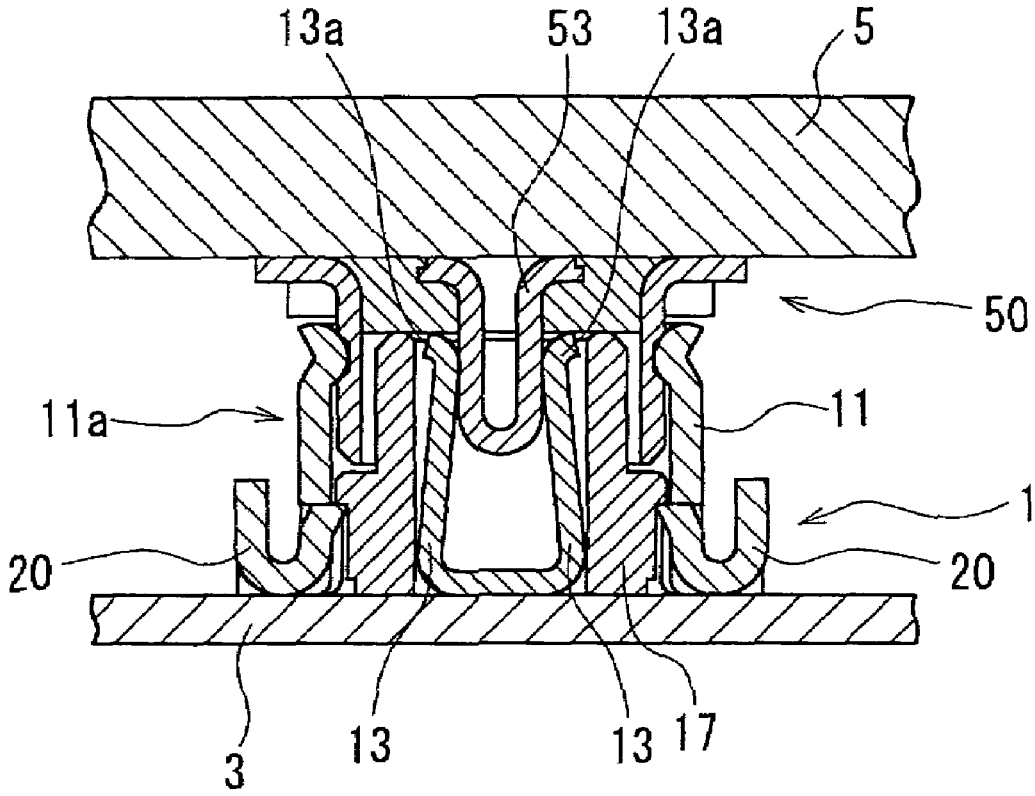
FIG. 5 A side cross-sectional view of the coaxial connector being connected with a corresponding connector.
Figure 6:
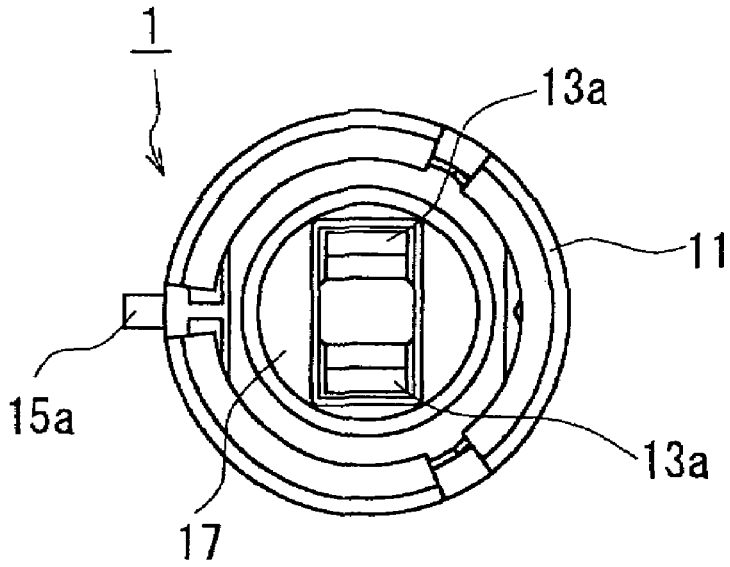
FIG. 6 A plan view of the second embodiment of the present invention.
Figure 7:
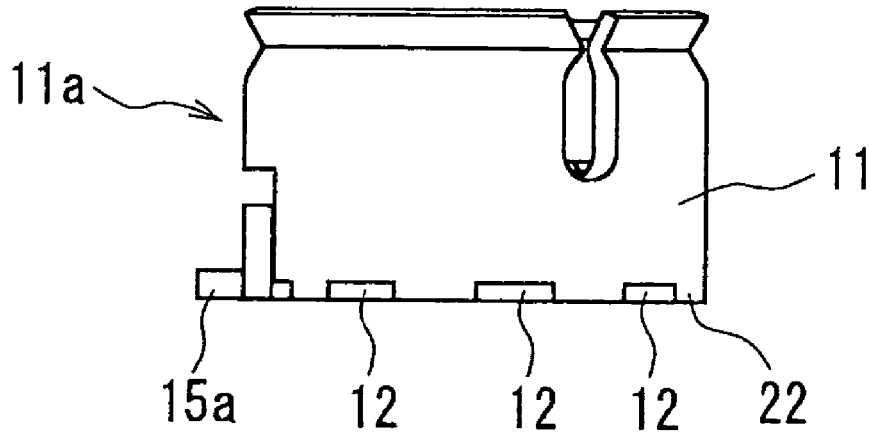
FIG. 7 A side view of the coaxial connector of FIG. 6.
Figure 8:
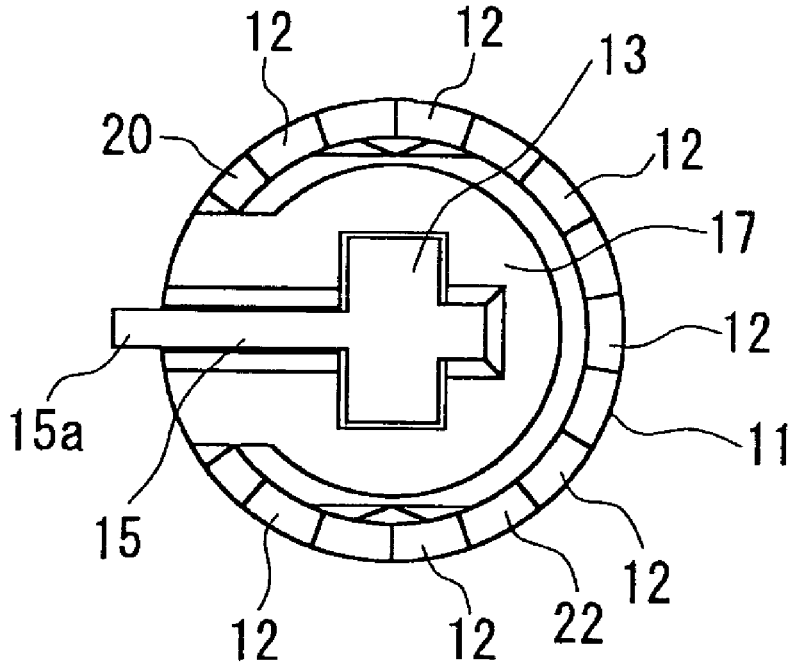
FIG. 8 A bottom plan view of the coaxial connector of FIG. 6.
Figure 9:
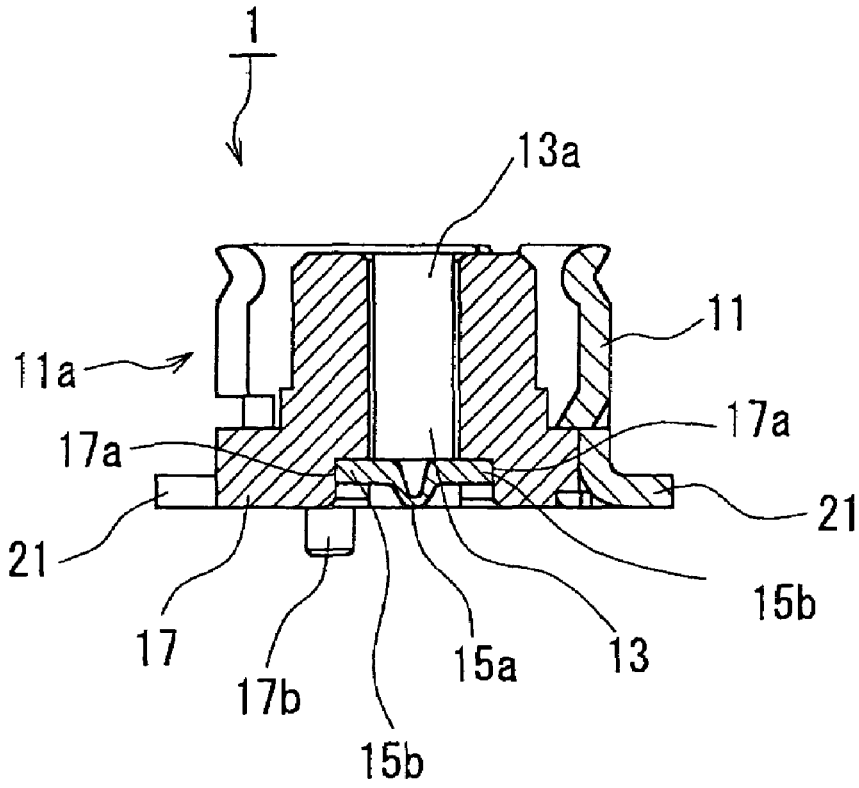
FIG. 9 A cross-sectional view of the coaxial connector of the third embodiment.
Figure 10:
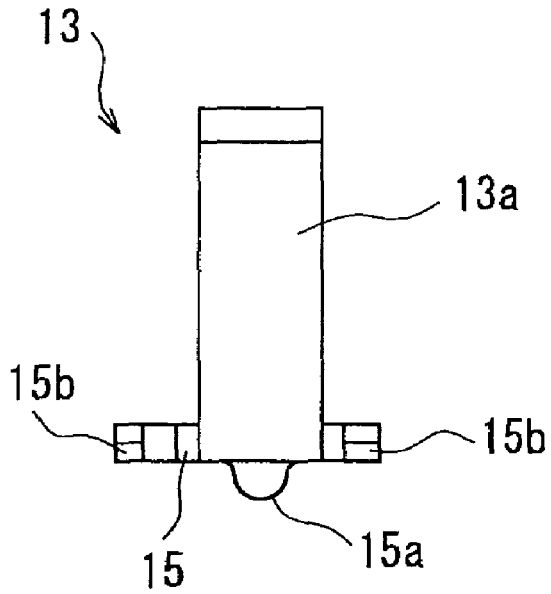
FIG. 10 A front view of the contact of the coaxial connector of the third embodiment.
Figure 11:
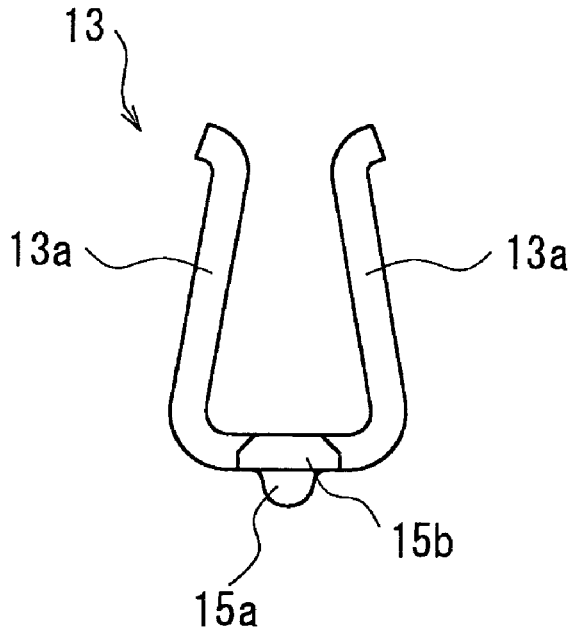
FIG. 11 A side view of the contact of FIG. 10.
Figure 12:
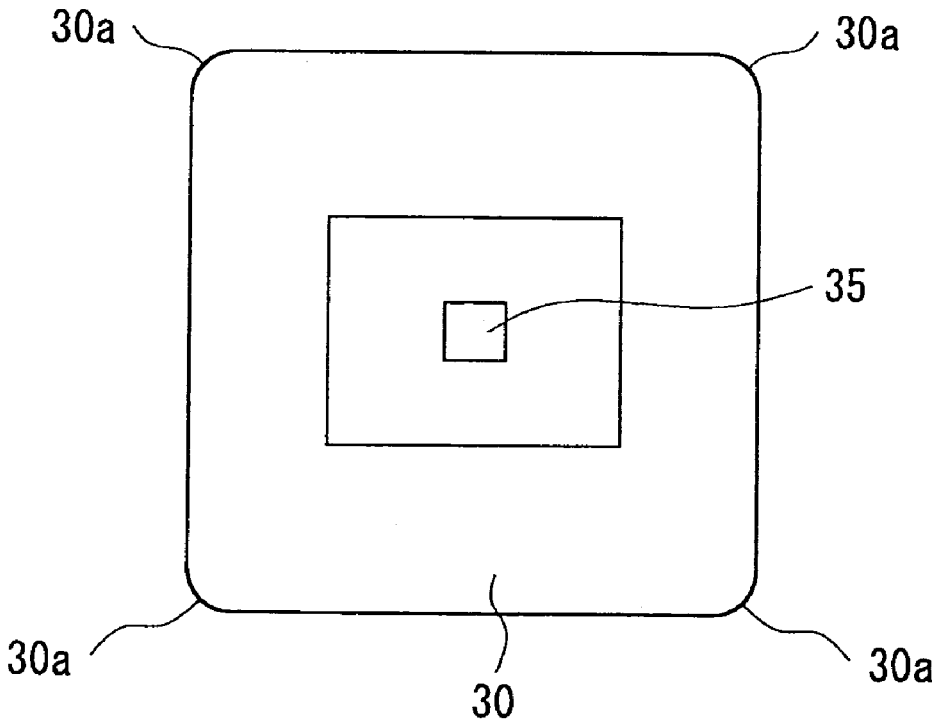
FIG. 12 A plan view that shows the form of a ground pad and pad
Figure 13:
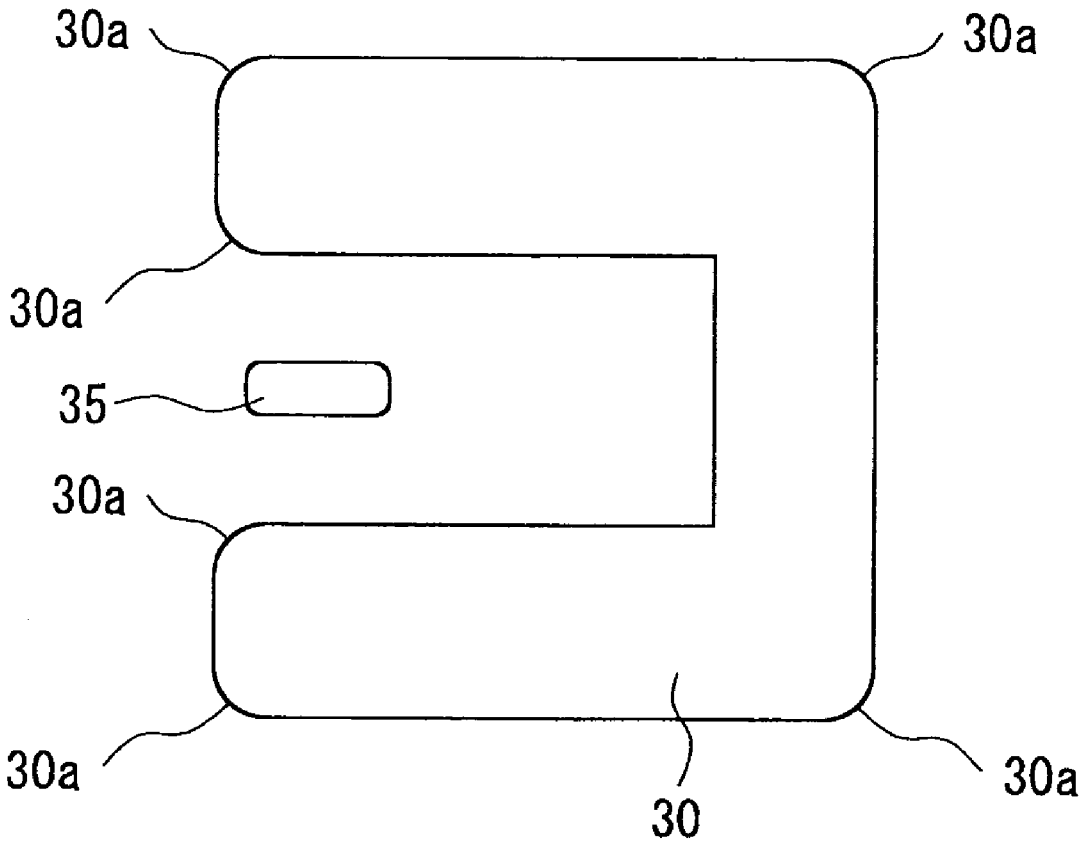
FIG. 13 A plan view that shows a different form of a ground pad and pad from the one in FIG. 12.
Figure 14:
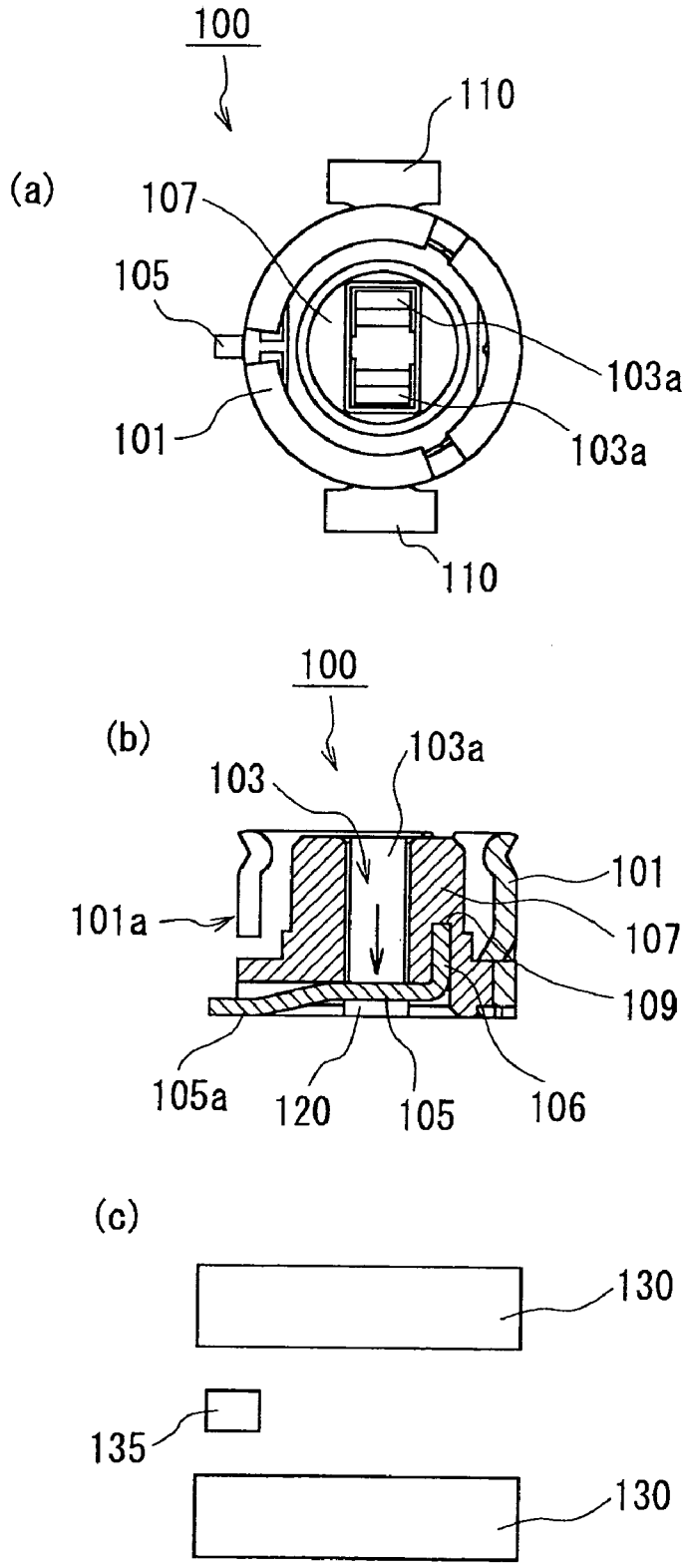
FIG. 14 (a) is a plan view of a conventional coaxial connector. (b) is its side cross-sectional view. (c) is a plan view of a conventional ground pad and pad.

1 coaxial connector
2 circuit board
11 shell
11*a* connecting section
12 cuts
13 contact
13*a* contact section
15 terminal section
15*a* signal terminal
17 insulator
17*a* insert cavity
17*b* positioning projections
20 first ground terminals
20*a* hooking section
21 second ground terminals
22 ground terminals
30 ground pad
35 pad

What is claimed is:

1. In a coaxial connector comprising:

a contact whose one end has a signal terminal that comes into contact with a conductive pad on a circuit board and is electrically connected with a contact of a corresponding connector, an insulator that holds said contact, and a metallic shell that contains said insulator and has ground terminals, said coaxial connector being characterized in that:

at least three ground terminals that land on ground pads mounted on said circuit board are arranged around a circle centered on said shell, said ground terminals having outward ends that extend outwardly from the shell further than said signal terminal, and said signal terminal being placed in a position within imaginary lines defined by the outward ends of said ground terminals.

2. In a coaxial connector mentioned in claim 1, said coaxial connector being characterized in that said contact has a substantially U shaped contact section that electrically connects with a contact of a corresponding connector and a terminal section that extends across a central bottom end of said contact section, an end of said terminal section opposite to said signal terminal is a terminal plunge-in part that is plunged into an insert cavity formed in said insulator and said terminal plunge-in part can be plunged in substantially perpendicularly to the inner surface of said insulator.

3. In the coaxial connector mentioned in claim 2, a coaxial connector being characterized in that said terminal section is flat and whose bottom surface can be attached to said circuit board without any gap.

4. In a ground pad on which a coaxial connector mentioned in claim 1 is mounted, a ground pad being characterized in that a ground pad that is formed on said circuit board is substantially square shaped or U shaped.

5. In the ground pad mentioned in claim 4 on which a coaxial connector is mounted, a ground pad being characterized in that at least the corners on the outer perimeter of said ground pad are obtusely beveled or rounded.

6. In a coaxial connector comprising:

a contact whose one end has a signal terminal that comes into contact with a conductive pad on a circuit board and is electrically connected with a contact of a corresponding connector, an insulator that holds said contact, and a metallic shell that contains said insulator and has ground terminals, said coaxial connector being characterized in that: said metallic shell is shaped cylindrically with a circular bottom end and the bottom end of said shell is a ground terminal to be connected to and grounded with a ground pad of the circuit board and is provided with cuts with certain intervals in between whose depth in the bottom end of the shell is designed to be approximately the same thickness as tin to be soldered therein.

7. In the coaxial connector mentioned in claim 6, said coaxial connector being characterized in that said contact has a substantially U shaped contact section that electrically connects with a contact of a corresponding connector and an terminal section that extends across the central bottom end of said contact section, an end of said terminal section opposite to said signal terminal is a terminal plunge-in part that is plunged into an insert cavity formed in said insulator and said terminal plunge-in part can be plunged in substantially perpendicularly to the inner surface of said insulator.

8. In a ground pad on which a coaxial connector mentioned in claim 6 is mounted, a ground pad being characterized in that a ground pad that is formed on said circuit board is substantially square shaped or U shaped.

9. In a ground pad on which a coaxial connector mentioned in claim 6 is mounted, a ground pad being characterized in that a ground pad that is formed on said circuit board is substantially square shaped or U shaped.

10. In the ground pad mentioned in claim 9 on which a coaxial connector is mounted, a ground pad being characterized in that at least the corners on the outer perimeter of said ground pad are obtusely beveled or rounded.

* * * * *